US010329122B1

(12) United States Patent
Schmidt et al.

(10) Patent No.: US 10,329,122 B1
(45) Date of Patent: Jun. 25, 2019

(54) H FRAME FOR A DOUBLE DECK ELEVATOR

(71) Applicant: OTIS ELEVATOR COMPANY, Farmington, CT (US)

(72) Inventors: Walter Thomas Schmidt, Marlborough, CT (US); Enrico Manes, Feeding Hills, MA (US); Bruce P. Swaybill, Farmington, CT (US); Zaffir A. Chaudhry, South Glastonbury, CT (US); Luke A. Mishler, Manchester, CT (US); Xiaodong Luo, South Windsor, CT (US); Richard J. Ericson, Southington, CT (US); Loi Cheng, South Windsor, CT (US); Shihemn Chen, Bolton, CT (US); Meghan Mastriano, East Haven, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/871,467

(22) Filed: Jan. 15, 2018

(51) Int. Cl.
*B66B 9/00* (2006.01)
*B66B 11/02* (2006.01)

(52) U.S. Cl.
CPC ..... *B66B 11/022* (2013.01); *B66B 9/00* (2013.01); *B66B 11/0273* (2013.01)

(58) Field of Classification Search
CPC ..... B66B 11/022; B66B 11/0213; B66B 11/0095; B66B 1/425; B66B 1/2433
See application file for complete search history.

(56) References Cited

U.S. PATENT DOCUMENTS 6,336,522 B1 1/2002 Fujita et al.
6,802,396 B2 10/2004 Naitoh
7,017,714 B2 3/2006 Fujita et al.
7,090,056 B2 8/2006 Fujita et al.
9,033,110 B2 * 5/2015 Husmann ..... B66B 11/022 187/249

(Continued)

FOREIGN PATENT DOCUMENTS

EP 1074503 A2 2/2001
JP 2001048447 A 2/2001

(Continued)

OTHER PUBLICATIONS

English Machine Translation of JP 2001-80856 published Mar. 2001.*

(Continued)

*Primary Examiner* — Diem M Tran
(74) *Attorney, Agent, or Firm* — Carlson, Gaskey & Olds

(57) ABSTRACT

An illustrative example elevator assembly includes a first elevator cab and a second elevator cab. An H frame supports the first elevator cab and the second elevator cab. The H frame has a plurality of vertically oriented beams and at least one horizontally oriented beam extending between the vertically oriented beams. The at least one horizontally oriented beam is spaced from ends of the vertically oriented beams and the H frame does not have any horizontally oriented beam at either end of the vertically oriented beams. At least one linear actuator is coupled with the first elevator cab and the second elevator cab. The linear actuator is configured to selectively cause movement of the elevator cabs relative to the H frame.

8 Claims, 1 Drawing Sheet

(56) References Cited

U.S. PATENT DOCUMENTS 9,102,502 B2 8/2015 Yamada et al.

FOREIGN PATENT DOCUMENTS

| | | | | | |
|---|---|---|---|---|---|
| JP | 2001080856 | A | * | 3/2001 | ..... B66B 11/0095 |
| JP | 2002087716 | A | | 3/2002 | |
| JP | 2004277117 | A | | 10/2004 | |
| JP | 2004307158 | A | | 11/2004 | |
| JP | 2005089093 | A | | 4/2005 | |
| JP | 2007055799 | A | | 3/2007 | |
| WO | 2011/082899 | A1 | | 7/2011 | |

OTHER PUBLICATIONS

Toshiba Elevator and Building Systems Corporation, Double Deck Elevator with Adjustable Floor Height in Roppongi Hills, Tokyo, https://www.toshiba-elevator.co.jp/elv/infoeng/technology/doubledeck/ Nov. 28, 2017.

* cited by examiner

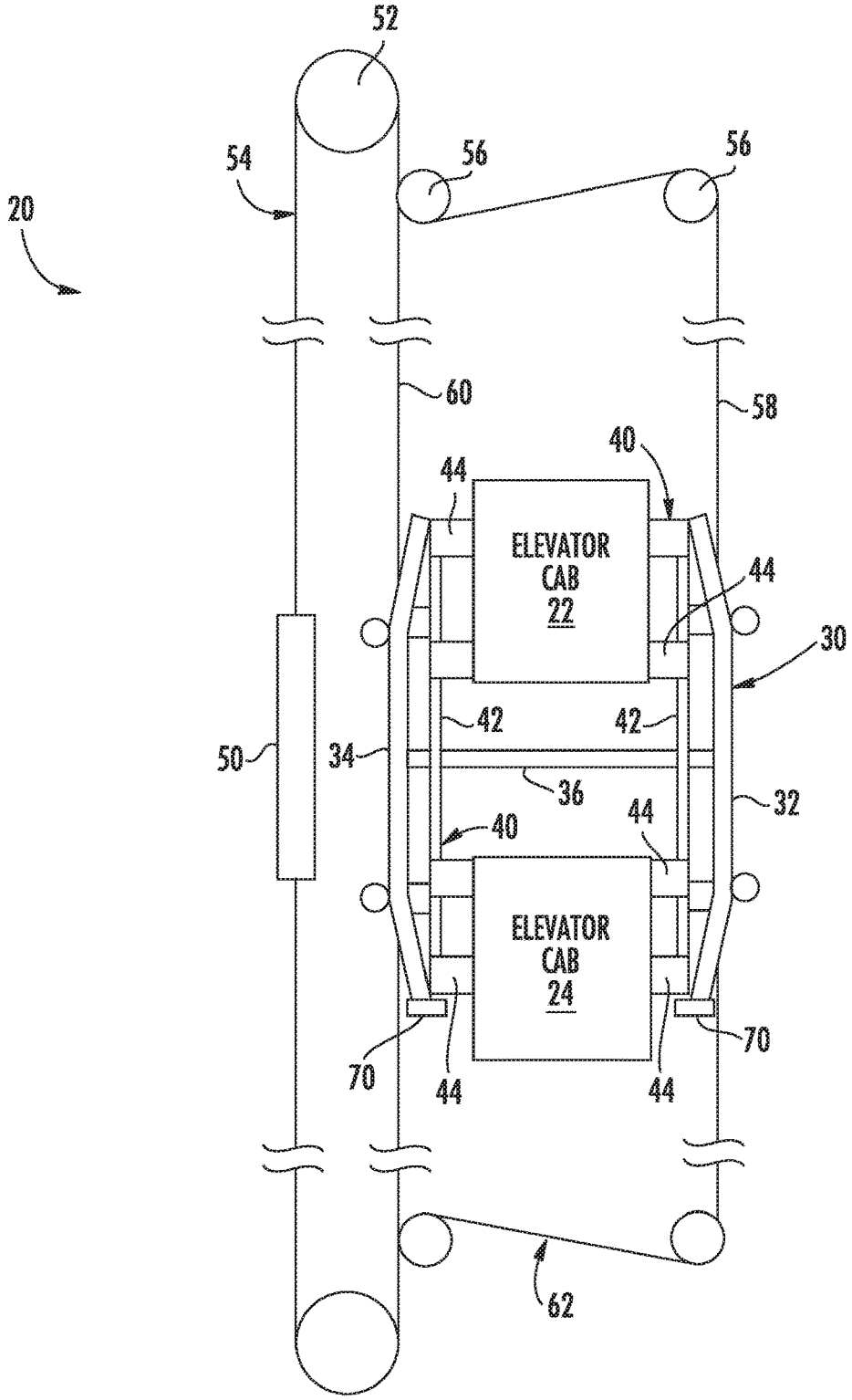
52
54
56
56
20
60
58
40
44
ELEVATOR
CAB
22
44
30
42
42
50
34
36
32
40
44
ELEVATOR
CAB
24
70
70
44
44
62

H FRAME FOR A DOUBLE DECK ELEVATOR

BACKGROUND

Elevator systems have proven useful for carrying passengers among various levels of buildings. Different building types present different challenges for providing adequate elevator service. Larger buildings that are more populated typically require increased elevator system capacity, especially at peak travel times. Different approaches have been suggested for increasing elevator system capacity.

One approach includes increasing the number of shafts or hoistways and elevator cars. This approach is limited because of the increased amount of building space required for each additional elevator. Another proposal has been to include more than one elevator car in each hoistway. Such arrangements have the advantage of increasing the number of cars without necessarily increasing the number of hoistways in a building. One of the challenges associated with systems having multiple cars in a single hoistway is maintaining adequate spacing between the cars and ensuring that they do not interfere with each other.

Another suggested approach has been to utilize a double deck elevator car in which two cabs are supported on a single frame in a manner that they both move in the elevator hoistway together. In some versions, the cabs can move relative to each other within the frame to adjust spacing between the cabs. Double deck elevators typically have heavier cars that require larger or more ropes, larger counterweights and larger motors. Each of these undesirably increases the cost of the system.

SUMMARY

An illustrative example elevator assembly includes a first elevator cab and a second elevator cab. An H frame supports the first elevator cab and the second elevator cab. The H frame has a plurality of vertically oriented beams and at least one horizontally oriented beam extending between the vertically oriented beams. The at least one horizontally oriented beam is spaced from ends of the vertically oriented beams and the H frame does not have any horizontally oriented beam at either end of the vertically oriented beams. At least one linear actuator is coupled with the first elevator cab and the second elevator cab. The linear actuator is configured to selectively cause movement of the elevator cabs relative to the H frame.

In an example embodiment having one or more features of the elevator assembly of the previous paragraph, the at least one linear actuator is coupled to the H frame and the first and second elevator cabs are respectively coupled to the at least one linear actuator.

In an example embodiment having one or more features of the elevator assembly of any of the previous paragraphs, the at least one linear actuator comprises at least one of a ball screw device, a lead screw device, a worm gear device, and a roller screw device.

In an example embodiment having one or more features of the elevator assembly of any of the previous paragraphs, the at least one linear actuator includes a plurality of threaded rods and a plurality of followers. The threaded rods are respectively situated near opposite sides of the elevator cabs. The threaded rods are coupled to the H frame and the threaded rods guide movement of the elevator cabs relative to the H frame.

In an example embodiment having one or more features of the elevator assembly of any of the previous paragraphs, the followers are coupled to the elevator cabs. The followers move along the threaded rods responsive to rotation of at least one of the followers or the threaded rods. Movement of the followers along the rods allows the elevator cabs to be situated beyond ends of the vertically oriented beams of the H frame.

In an example embodiment having one or more features of the elevator assembly of any of the previous paragraphs, the followers are coupled to the elevator cabs. The followers move along the threaded rods responsive to rotation of at least one of the followers or the threaded rods and the first elevator cab and the second elevator cab move in opposite directions simultaneously responsive to the rotation.

In an example embodiment having one or more features of the elevator assembly of any of the previous paragraphs, load bearing roping supports the H frame and the elevator cabs. The load bearing roping is coupled to the vertically oriented beams on opposite sides of the elevator cabs.

In an example embodiment having one or more features of the elevator assembly of any of the previous paragraphs, a counterweight is supported by the load bearing roping. Compensation roping is coupled to the counterweight and the vertically oriented beams of the H frame.

In an example embodiment having one or more features of the elevator assembly of any of the previous paragraphs, the load bearing roping comprises at least one of round steel ropes and flat belts.

In an example embodiment having one or more features of the elevator assembly of any of the previous paragraphs, a buffer strike plate is located near a bottom of the vertically oriented beams.

The various features and advantages of at least one disclosed example embodiment will become apparent to those skilled in the art from the following detailed description. The drawing that accompanies the detailed description can be briefly described as follows.

BRIEF DESCRIPTION OF THE DRAWING

FIG. 1 schematically illustrates selected portions of an elevator system designed according to an embodiment of this invention.

DETAILED DESCRIPTION

FIG. 1 schematically illustrates selected portions of an elevator system 20 including a first elevator cab 22 and a second elevator cab 24 that are supported by an H frame 30 so that the elevator cabs 22 and 24 move together among various levels within a building, for example.

The H frame 30 includes vertically oriented beams 32 and 34 and at least one horizontally oriented beam 36. There are no horizontally oriented beams near the ends of the vertically oriented beams 32 and 34, giving the frame 30 an H shape. The horizontally oriented beam 36 in this example is at an approximate vertical midpoint along the vertically oriented beams 32 and 34, which is a position spaced away from the ends of the vertically oriented beams 32 and 34.

At least one linear actuator 40 is supported by the H frame 30 and coupled with the first elevator cab 22 and the second elevator cab 24. In the illustrated example, there are two linear actuators 40 with one on each side of the elevator cabs 22 and 24.

The linear actuators 40 in this example comprise at least one of a ball screw device, a lead screw device, a worm gear device and a roller screw device. Some embodiments include ACME screw devices. With some thread designs it is possible to make the linear actuator non-back-drivable, which can provide benefits in some embodiments.

The linear actuators 40 include a threaded rod 42 and followers 44. A motor (not specifically illustrated) causes relative rotation between the rod 42 and the followers 44 to cause relative movement of the followers 44 along the rod 42. In the illustrated example, the followers 44 rotate causing vertical translation (i.e., linear motion) of the elevator cabs 22, 24 along the respective rod 42, which results in a change in the relative positions of the elevator cabs 22, 24.

The rods 42 and followers 44 in some embodiments are configured so that rotation of the rods 42 in one direction causes the elevator cabs 22 and 24 to move closer together (i.e., the first elevator cab 22 to move downward relative to the H frame 30 and the second elevator cab 24 to move upward relative to the H frame 30). Rotation of the threaded rods 42 in an opposite direction results in the elevator cabs 22 and 24 moving further away from each other (i.e., the first elevator cab 22 moving upward relative to the H frame 30 and the second elevator cab 24 moving downward relative to the H frame 30). In such embodiments, the threaded rods 42 are coupled with the H frame 30 in a manner that allows the rods 42 to rotate and provides a stable placement and position of the rods 42 on the H frame 30.

In the illustrated example, the rods 42 serve as the guide members to guide vertical movement of the elevator cabs 22, 24 relative to the H frame 30. One feature of the illustrated example embodiment is that the rods 42 serve the dual purpose of guiding movement of the elevator cabs relative to the H frame 30 and causing such movement. This reduction of parts reduces the weight of the elevator car. As noted above, a significant challenge associated with double deck elevators is the weight typically associated with the double deck car. Reducing weight by using an arrangement designed according to an embodiment of this invention, therefore, provides an improvement.

Another weight savings aspect of the illustrated example is that the H frame 30 does not require a header beam at the top of the frame or a plank beam at the bottom of the frame. Fewer beams or frame members reduces the overall weight of the double deck elevator car.

Another aspect of the H frame 30 is that it allows for the elevator cabs 22 and 24 to move vertically relative to each other and the H frame 30 over a wider range than if a header and plank beam were included on the frame 30. As illustrated in FIG. 1, the elevator cabs can be placed in positions where the cabs extend beyond the upper and lower limits of the H frame 30. The only limitation on the range of movement of the elevator cabs 22 and 24 relative to the H frame 30 is the size of the rods 42 and the manner in which the followers 44 are coupled with the elevator cabs 22, 24.

Since there is no header beam on the H frame 30, the double deck elevator car is suspended in a traction-based elevator system in a unique manner. The example embodiment of FIG. 1 includes a counterweight 50 and a traction sheave 52 that causes movement of a roping arrangement 54 to achieve desired movement of the elevator cabs 22 and 24 within a hoistway (not specifically illustrated). The roping arrangement 54 supports the load of the H frame 30, the elevator cabs 22, 24 and the load of the counterweight 50. Deflection sheaves 56 are included to direct at least some of the load bearing members 58 of the roping arrangement 54 to one side of the H frame 30 while others of the loading bearing members 60 of the roping arrangement 54 are directed to an opposite side of the H frame 30. In the illustrated example, the load bearing members 58 and 60 are secured to the vertically oriented beams 32 and 34, respectively. The load bearing members 58 and 60 comprise round ropes in some embodiments and flat belts in other embodiments.

Compensation roping 62 is configured in a similar manner to provide compensation while being coupled with the vertically oriented beams 32 and 34.

Given that there is no horizontally oriented plank beam near the lower ends of the vertically oriented beams 32 and 34, the illustrated example embodiment includes buffer strike plates 70 near the lower ends of the vertically oriented beams 32 and 34. The buffer strike plates 70 are configured to contact a pit buffer (not illustrated) under circumstances in which such contact is required.

The example arrangement shown in FIG. 1 provides significant cost and weight savings for a double deck elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator assembly, comprising:

a first elevator cab;

a second elevator cab;

an H frame supporting the first elevator cab and the second elevator cab, the H frame having a plurality of vertically oriented beams and at least one horizontally oriented beam extending between the vertically oriented beams, the at least one horizontally oriented beam being spaced from ends of the vertically oriented beams, the H frame having no horizontally oriented beam at either end of the vertically oriented beams; and at least one linear actuator coupled to the H frame and coupled with the first elevator cab and the second elevator cab, the at least one linear actuator being configured to selectively cause movement of the elevator cabs relative to the H frame, wherein the at least one linear actuator includes a plurality of threaded rods and a plurality of followers;

the threaded rods are respectively situated near opposite sides of the elevator cabs;

the threaded rods are coupled to the H frame; and the threaded rods guide movement of the elevator cabs relative to the H frame.

2. The elevator assembly of claim 1, wherein the at least one linear actuator comprises at least one of a worm gear device, a ball screw device, a roller screw device, and a lead screw device.

3. The elevator assembly of claim 1, wherein the followers are coupled to the elevator cabs;

the followers move along the threaded rods responsive to rotation of at least one of the followers or the threaded rods; and movement of the followers along the rods allows the elevator cabs to be situated beyond ends of the vertically oriented beams of the H frame.

4. The elevator assembly of claim 1, wherein the followers are coupled to the elevator cabs;

the followers move along the threaded rods responsive to rotation of at least one of the followers or the threaded rods; and the first elevator cab and the second elevator cab move in opposite directions simultaneously responsive to the rotation.

5. The elevator assembly of claim 1, comprising load bearing roping that supports the H frame and the elevator cabs, the load bearing roping being coupled to the vertically oriented beams on opposite sides of the elevator cabs.

6. The elevator assembly of claim 5, comprising a counterweight supported by the load bearing roping; and compensation roping coupled to the counterweight and the vertically oriented beams of the H frame.

7. The elevator assembly of claim 5, wherein the load bearing roping comprises at least one of round steel ropes and flat belts.

8. The elevator assembly of claim 1, comprising a buffer strike plate near a bottom of the vertically oriented beams.

* * * * *